US009046813B1

(12) United States Patent
Massaro, Jr.

(10) Patent No.: US 9,046,813 B1
(45) Date of Patent: Jun. 2, 2015

(54) PRINTER CARTRIDGE WITH TONER WALL

(71) Applicant: Peter Vincent Massaro, Jr., West Haven, CT (US)

(72) Inventor: Peter Vincent Massaro, Jr., West Haven, CT (US)

(73) Assignee: FLO-TECH, LLC, Middletown, CT (US)

( * ) Notice: Subject to any disclaimer, the term of this patent is extended or adjusted under 35 U.S.C. 154(b) by 0 days.

(21) Appl. No.: 14/147,264

(22) Filed: Jan. 3, 2014

Related U.S. Application Data

(60) Provisional application No. 61/907,761, filed on Nov. 22, 2013.

(51) Int. Cl.
*G03G 15/08* (2006.01)

(52) U.S. Cl.
CPC ..... *G03G 15/0806* (2013.01)

(58) Field of Classification Search
CPC ..... G03G 15/0806
USPC ..... 399/273, 274, 283, 284
See application file for complete search history.

(56) References Cited

U.S. PATENT DOCUMENTS

| | | | | | |
|---|---|---|---|---|---|
| 4,193,376 | A * | 3/1980 | Hamaguchi et al. | 399/272 |
| 4,328,762 | A * | 5/1982 | Wada | 399/236 |
| 4,334,497 | A * | 6/1982 | Oka et al. | 118/698 |
| 4,435,065 | A * | 3/1984 | Wada | 399/260 |
| 4,438,722 | A * | 3/1984 | Forlani | 399/272 |
| 4,523,833 | A * | 6/1985 | Jones | 399/272 |
| 4,544,935 | A * | 10/1985 | Sakai | 347/151 |
| 4,660,958 | A * | 4/1987 | Egami et al. | 399/273 |
| 4,676,192 | A * | 6/1987 | Yuge et al. | 399/259 |
| 4,755,847 | A * | 7/1988 | Matsushiro et al. | 399/284 |
| 4,916,492 | A * | 4/1990 | Hoshika et al. | 399/272 |
| 5,188,057 | A * | 2/1993 | Ishikawa et al. | 399/272 |
| 5,761,589 | A * | 6/1998 | Kido et al. | 399/284 |
| 6,658,228 | B2 * | 12/2003 | Wada | 399/272 |
| 7,567,764 | B2 * | 7/2009 | Yamanaka et al. | 399/53 |
| 7,664,442 | B2 * | 2/2010 | Takashima et al. | 399/281 |
| 2001/0038761 | A1 * | 11/2001 | Ochiai | 399/252 |
| 2003/0228158 | A1 * | 12/2003 | Smith et al. | 399/26 |
| 2005/0084300 | A1 * | 4/2005 | Choi et al. | 399/281 |
| 2006/0133858 | A1 * | 6/2006 | Hirayama et al. | 399/273 |
| 2007/0177906 | A1 * | 8/2007 | Yamanaka et al. | 399/279 |
| 2012/0051797 | A1 * | 3/2012 | Suzuki et al. | 399/272 |
| 2013/0216277 | A1 * | 8/2013 | Endou et al. | 399/284 |

* cited by examiner

*Primary Examiner* — Rodney Fuller
(74) *Attorney, Agent, or Firm* — Bachman & LaPointe, P.C.

(57) ABSTRACT

An improved printer cartridge is provided with a barrier for reducing pressure on printing assembly components in an extended yield cartridge. A printing assembly, including cartridge casing, magnetic developer roller, and hopper, is provided for use with laser printers. A barrier formed by a base and a wall is positioned within the cartridge casing, between the magnetic developer roller and a feed section of the hopper. The wall of the barrier is tangent to the magnetic developer roller, minimizing the area of the magnetic developer roller which is exposed to a medium stored within the hopper and feed section, such as toner. Since exposed surface area is reduce, the amount of pressure on the magnetic developer roller is correspondingly reduced, allowing for an increase in lifespan for the magnetic roller and interactive components, primarily a doctor blade and sealing blade.

12 Claims, 6 Drawing Sheets

PRINTER CARTRIDGE WITH TONER WALL

The current application claims a priority to the U.S. Provisional Patent application Ser. No. 61/907,761 filed on Nov. 22, 2013.

FIELD OF THE INVENTION

The present invention relates generally to an apparatus for reducing the force applied to a magnetic roller by toner in an extended yield toner cartridge.

BACKGROUND OF THE INVENTION

At one time expensive, bulky, and affordable only to large businesses, laser printers have become an accessible and economic option for the modern consumer. Laser printers offer a number of advantages compared to inkjet printers, the most prominent of which is the lower operating cost. The cost per page of inkjet printers is an order of magnitude higher than that of laser printers. These benefits can be enhanced through the use of extended yield cartridges, which hold more toner than a regular cartridge. Extended yield toner cartridges increase the amount of pages that can be printed with a single cartridge. They provide further benefits in that the cost per page is less than that of a regular or starter cartridge. Additionally, material use and costs are reduced compared to regular cartridges, resulting in a more environmentally friendly and cost-efficient toner cartridge. However, extended yield cartridges are prone to premature failure and quick wearing out of parts, as the cartridges hold more toner than originally designed for.

It is therefore an object of the present invention to reduce the force applied to a magnetic roller in an extended yield cartridges by providing a wall which minimizes contact between the magnetic roller and the stored toner.

DETAIL DESCRIPTIONS OF THE INVENTION

Figure 1:
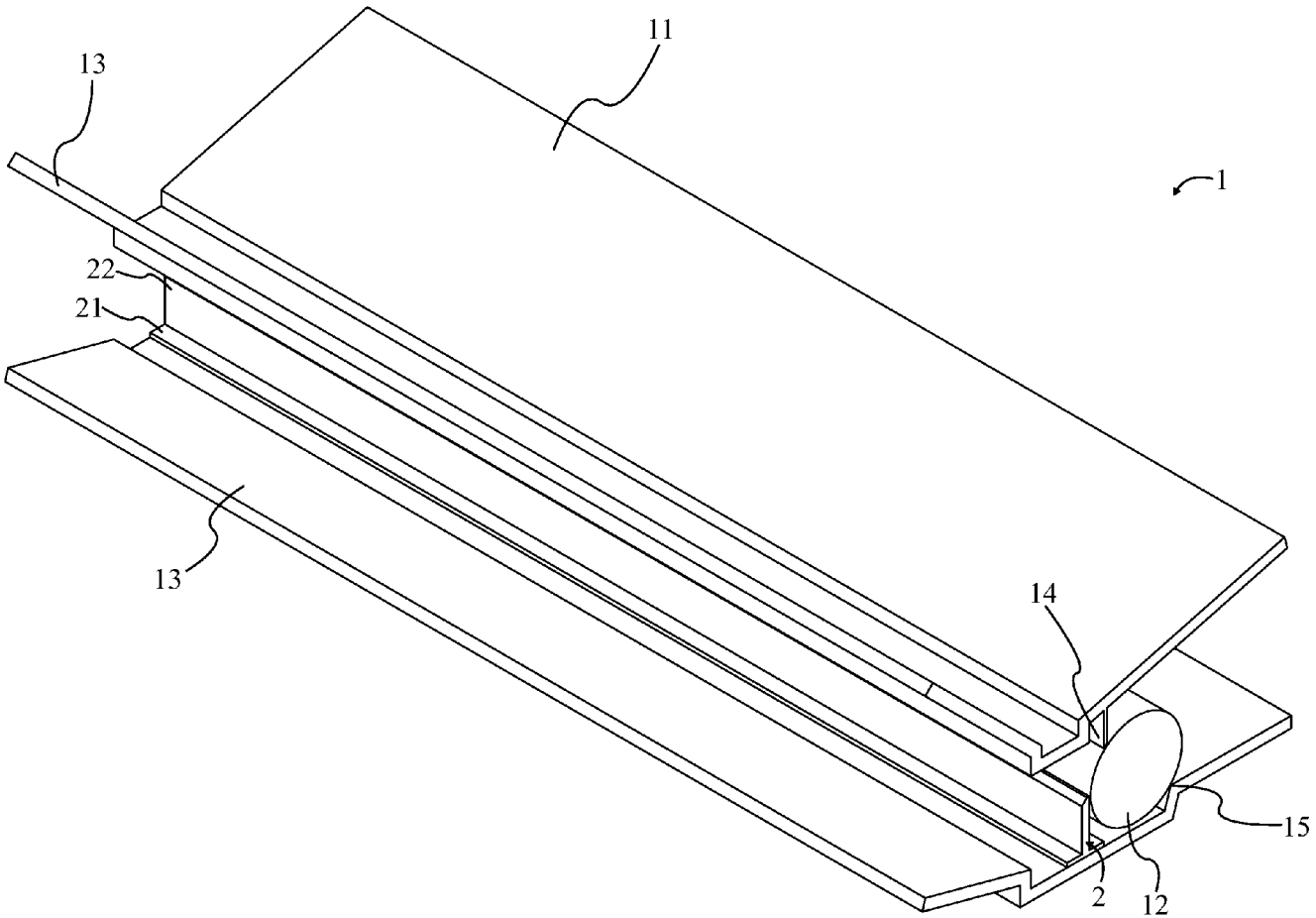
FIG. 1 is a perspective view showing the present invention.

All illustrations of the drawings are for the purpose of describing selected versions of the present invention and are not intended to limit the scope of the present invention.

The present invention is an improved printer cartridge provided for laser printers. Designed to reduce the stress applied to developer components when using extended yield cartridges, the present invention can be implemented as a retrofit to an existing toner cartridge or as an independent toner cartridge. Shown in FIG. 1-FIG. 3, the present invention comprises a printing assembly 1 and a barrier 2, with the barrier 2 being housed in the printing assembly 1. The printing assembly 1 comprises a cartridge casing 11, a magnetic developer roller 12, and a hopper 13. The cartridge casing 11 forms an enclosure that encases and secures the components of the present invention. The magnetic developer roller 12, known in the art, is used to gather a film of toner for transfer to a photo conductor drum. The hopper 13 holds a medium 3 (in the preferred embodiment this is the toner which eventually forms the printed words on a sheet of paper) and supplies the medium 3 to the magnetic developer roller 12 to initiate the printing process. The barrier 2 creates an additional chamber in the toner reservoir, adjacent to the magnetic developer roller 12. With this placement, the present invention reduces the amount of toner that contacts and applies force to the magnetic developer roller 12, extending roller lifespan and combating premature failure. The reduced pressure on the magnetic developer roller 12 has a cascading effect, as less wear is experienced by a doctor blade 14 and a sealing blade 15, extending the lifespan of those components as well. Furthermore, the reduced force on the sealing blade 15 helps maintain its ideal position and subsequently reducing friction on the magnetic developer roller 12, once again acting to extend cartridge lifespan and durability.

Figure 2:
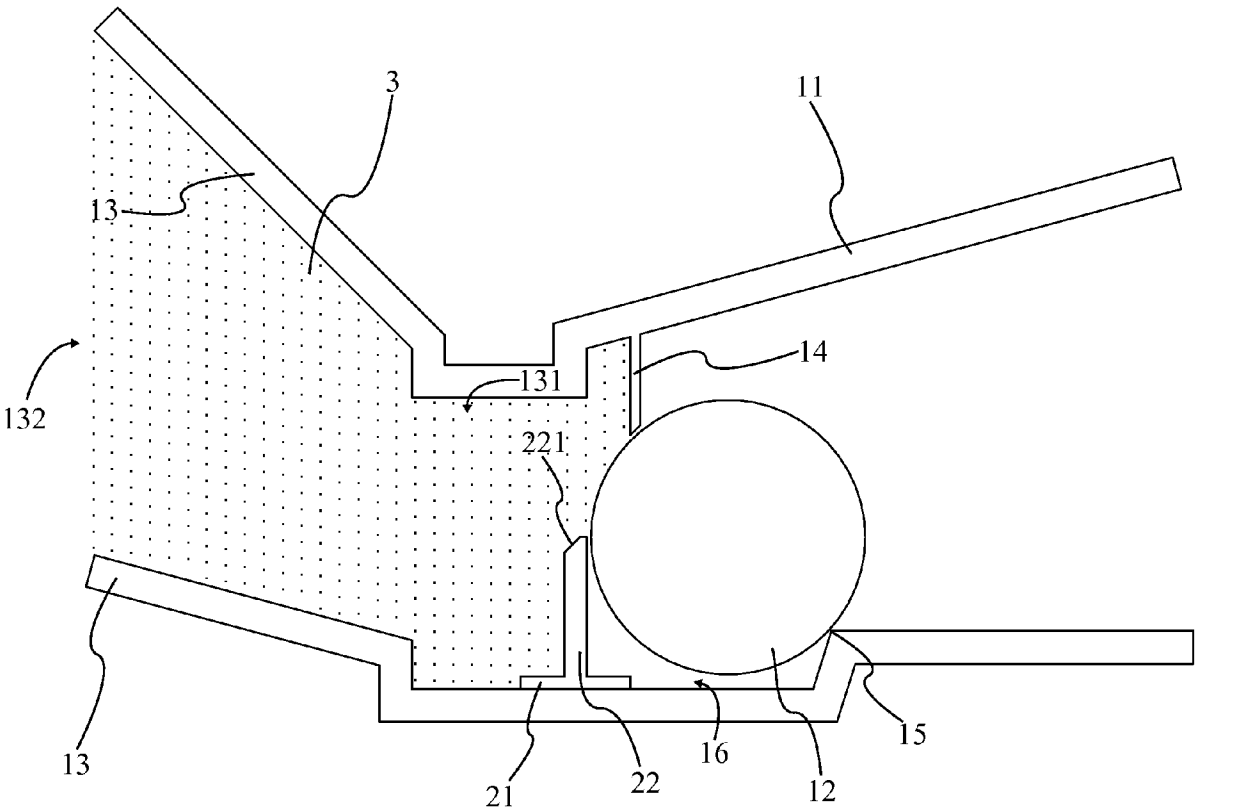
FIG. 2 is a side view showing a barrier's positioning relatively to a printing assembly of the present invention.
Figure 3:
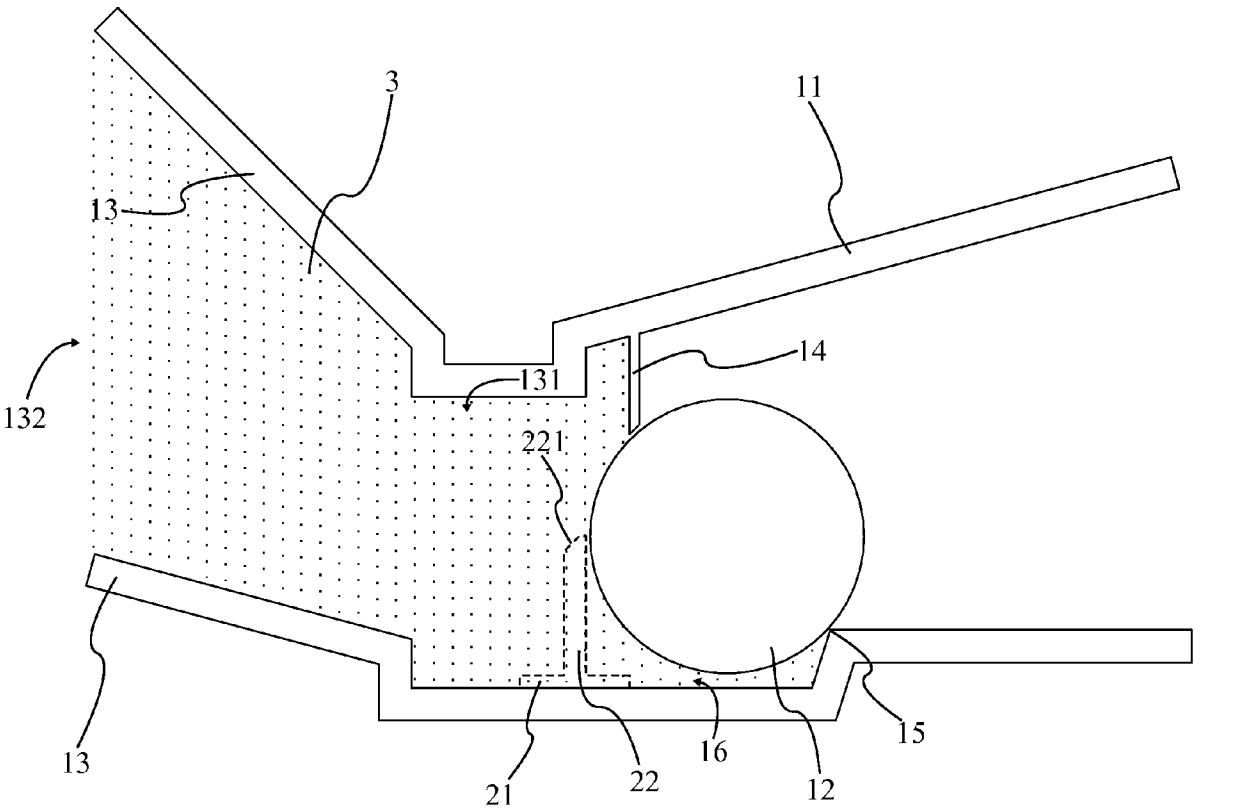
FIG. 3 is a side view showing the increased contact between a medium and a magnetic developer roller sans the barrier of the present invention.

Further elaborating upon the printing assembly 1, the hopper 13 comprises a feed section 131 and a medium receiving volume 132, as seen in FIG. 2 and FIG. 3. The feed section 131 is adjacent to the magnetic developer roller 12 and allows the magnetic developer roller 12 to pick up the medium 3 from the hopper 13 for transfer to the photo conductor drum. More specifically, the feed section 131 allows medium 3 (e.g. toner) to flow from the adjacently positioned medium receiving volume 132 to the magnetic developer roller 12. The medium 3 held within the feed section 131 is directly fed to the magnetic developer roller 12 and replaced by the medium 3 in the medium receiving volume 132. The magnetic developer roller 12 is rotatably mounted within the cartridge casing 11, where it is positioned lateral and adjacent to the feed section 131. This allows the magnetic developer roller 12 to gather toner from the feed section 131, with the toner being transferred to the photo conductor drum via rotation of the magnetic developer roller 12.

Figure 4:
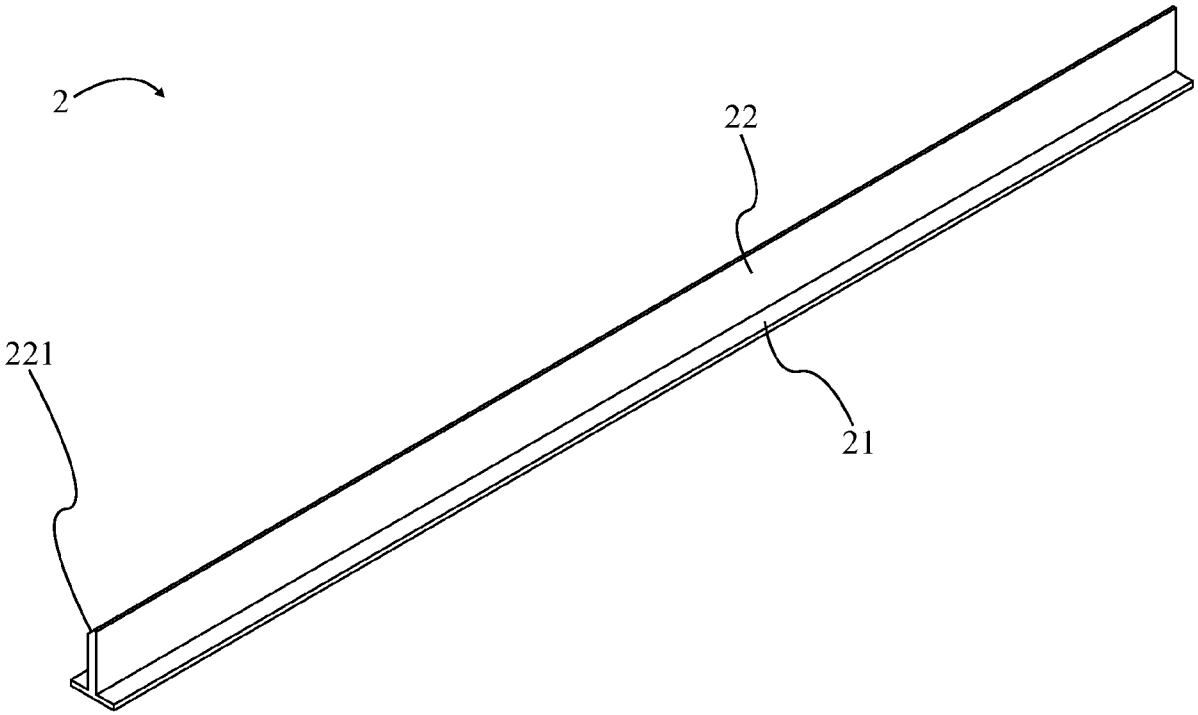
FIG. 4 is a perspective view of the barrier of the present invention.
Figure 5:
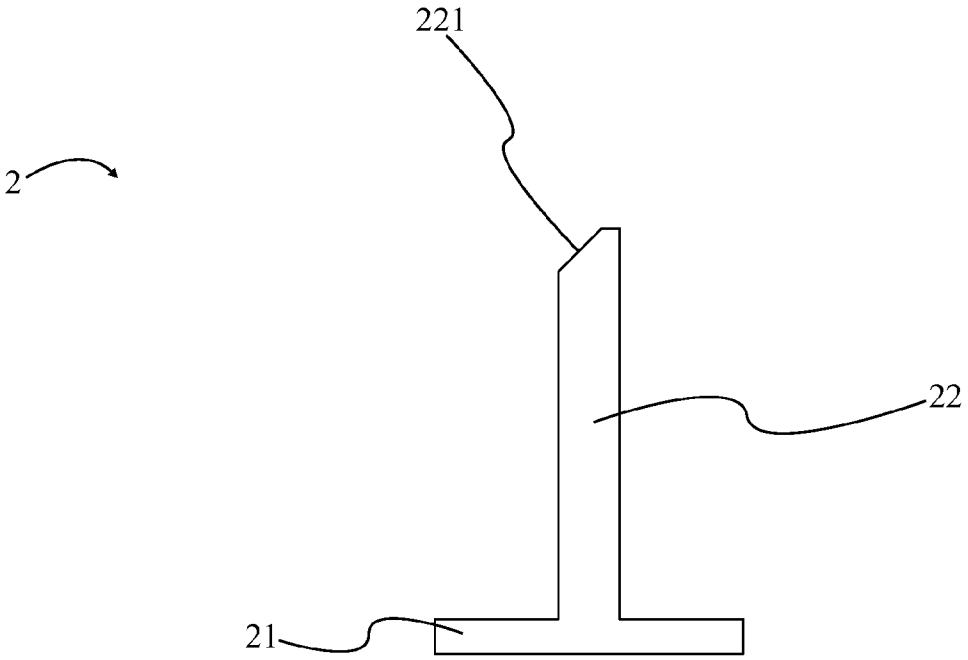
FIG. 5 is a side view of the barrier of the present invention.
Figure 6:
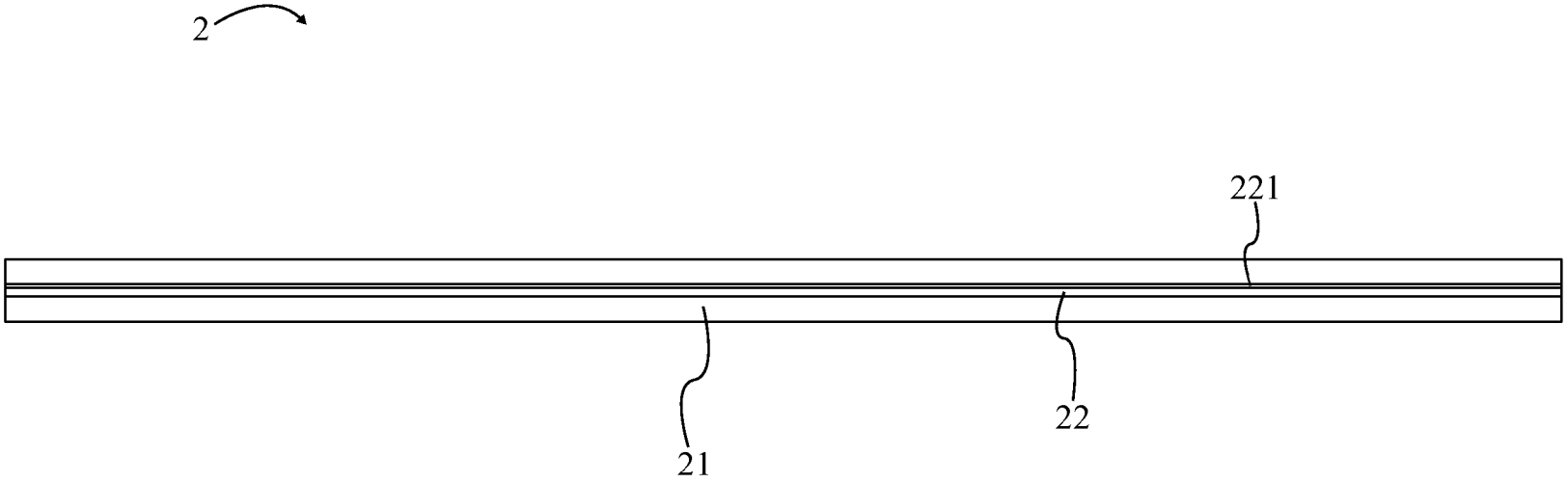
FIG. 6 is a top view of the barrier of the present invention.

In order to reduce pressure on the magnetic developer roller 12, the barrier 2 is mounted within the cartridge casing 11. The barrier 2 is positioned adjacent to magnetic developer roller 12 and into the feed section 131, such that it separates a portion of the magnetic developer roller 12 from the medium 3 stored within the hopper 13. In this manner the barrier 2 limits exposure of the surface area of the magnetic developer roller 12 to the medium 3 (i.e. the toner) in the feed section 131. The reduced exposure minimizes contact between the magnetic developer roller 12 and the medium 3, which in turn reduces the overall pressure experienced by the magnetic developer roller 12. This is extremely beneficial for extended yield cartridges where the amount of medium 3 stored in the hopper 13 exceeds Original Equipment Manufacturer (OEM) specifications. The positioning of the barrier 2 is illustrated in FIG. 1. FIG. 2 shows how the barrier 2 protects the magnetic developer roller 12 from excessive pressure, in contrast with FIG. 3 which illustrates increased pressure from the medium 3 when the barrier 2 is not used. The barrier 2, as illustrated in FIG. 4-FIG. 6, comprises a base 21 and a wall 22, with the base 21 serving as a support that allows the barrier 2 to be mounted to the cartridge casing 11. The wall 22 is interposed between the magnetic developer roller 12 and the feed section 131, closing off a portion of the magnetic developer roller 12 from the medium 3. The wall 22 is adjacently connected to the base 21, allowing for the wall 22 to be tangentially aligned with the magnetic developer roller 12. In the preferred embodiment the wall 22 is perpendicular to the base 21, although in other embodiments the orientation of the wall 22 might vary due to differences in design of the cartridge casing 11 (which receives the base 21). Ultimately, the angle between the base 21 and wall 22 can be adjusted as necessary in order to achieve a tangential relation between the wall 22 and the magnetic developer roller 12.

The positioning of the barrier 2 creates a medium-free chamber 16, the boundaries of which are delineated by the magnetic developer roller 12, the barrier 2, and the cartridge casing 11. This medium-free chamber 16 is visualized in FIG. 2 and FIG. 3. The barrier 2 prevents the medium 3 from entering the medium-free chamber 16, creating a zone of reduced pressure with regards to the magnetic developer roller 12. The creation of the medium-free chamber 16 is also dependent upon a tangential relation between the wall 22 of the barrier 2 and the magnetic developer roller 12. If the wall 22 is not tangent to the magnetic developer roller 12, a resulting gap between the magnetic developer roller 12 and the wall 22 could potentially allow medium 3 to enter the medium-free chamber 16, contact a greater area of the magnetic developer roller 12, and as such reduce effectiveness of the barrier 2.

The base 21 is adjacently connected to the cartridge casing 11, ensuring the barrier 2 remains in place and is not moved due to pressure applied by the medium 3. In the preferred embodiment the base 21 is connected by means of a double-sided adhesive, which is adjacently connected to the base 21 opposite the wall 22. The double-sided adhesive (e.g. double-sided tape) can then be pressed against the cartridge casing 11, allowing the barrier 2 to be secured in position. The use of a double-sided tape adhesive serves as an easy, inexpensive, and tool-free method for securing the present invention in place. Potentially, in other embodiments, alternative methods of connecting the base 21 to the cartridge casing 11 could be use. For example, simple fasteners (e.g. screws or nails) can be drilled or hammered through the base 21 into the cartridge casing 11. This alternative connection is very secure, but requires more tools and may be more difficult to use in a retrofitting process than the preferred double-sided adhesive. Another option is a variation of the preferred double-sided adhesive, instead using a fluid adhesive such as glue. Though not as clean as a double-sided adhesive, it is relatively simple to use and is also does not require tools or drilling for utilization. Ultimately, any alternative connection method is suitable for use with the present invention as long as it is capable of holding the barrier 2 in place and not being moved, damaged, or otherwise compromised by pressure applied from the medium 3.

It is noted that in order to maximize effectiveness the barrier 2, i.e. its comprised base 21 and wall 22, should be connected across the cartridge casing 11. Otherwise gaps may be left between the barrier 2 and the interior faces of the cartridge casing 11, allowing at least some of the medium 3 to bypass the barrier 2.

The wall 22 of the base 21 comprises a chamfered edge 221. This chamfered edge 221 is positioned on an edge of the wall 22 opposite the base 21, at a "top face" of the wall 22 if considering the face which is connected to the base 21 to be a "bottom face". The chamfered edge 221 is oriented towards the feed section 131 and away from the magnetic developer roller 12. Returning to the top face reference, the chamfered edge 221 can be considered a second top edge of the wall 22. A first top edge is positioned adjacent to the magnetic developer roller 12 while the second top edge (i.e. the chamfered edge 221) is positioned adjacent to the first top edge opposite the magnetic developer roller 12. This implementation of the chamfered edge 221 is beneficial as it slopes towards the feed section 131, ensuring that excess medium 3 remains in the hopper 13. If the chamfer was positioned on the edge adjacent to the magnetic developer roller 12, the medium 3 could potentially slide down the chamfered edge 221 towards the medium-free chamber 16 formed between the magnetic developer roller 12, the barrier 2, and the cartridge casing 11. Since the medium-free chamber 16 is essential in reducing the total force applied to the magnetic developer roller 12, sealing the medium 3-free chamber 16 is critical as any medium 3 that manages to get in reduces the effectiveness of the present invention.

The chamfered edge 221 (and subsequently the top face of the wall 22) is preferably parallel with a rotational axis of the magnetic developer roller 12, such that the top face of the wall 22 is coplanar with the rotational axis. This positioning of the top wall 22 results in a substantial reduction of the exposure surface area of the magnetic developer roller 12 to the medium 3, in the realm of 50%. This positioning also allows for some contact between the medium 3 and the magnetic developer roller 12, which is necessary for the printing assembly 1 to function normally; if the medium 3 cannot come in contact with the magnetic developer roller 12 at all, then the printing assembly 1 will not be capable of printing.

The printing assembly 1 further comprises a doctor blade 14 and a sealing blade 15, both known in the art. The doctor blade 14 interacts with the magnetic developer roller 12, dislodging excess medium 3 as the magnetic developer roller 12 rotates to ensure that only a thin film remains on the magnetic developer roller 12. This thin film is ideal and desirable for transfer to the photo conductor drum, which the magnetic developer roller 12 as it rotates past the doctor blade 14. The doctor blade 14 is positioned within the cartridge casing 11 such that it tangentially engages the magnetic developer roller 12. In this manner the doctor blade 14 is capable of scraping off medium 3 from the magnetic developer roller 12, leaving only the aforementioned desired thin film of medium 3. To ensure the doctor blade 14 properly contacts the magnetic developer roller 12, the doctor blade 14 is radially and adjacently positioned around the magnetic developer roller 12. Relative to the rotation of the magnetic developer roller 12, the doctor blade 14 is positively offset from the barrier 2. That is, the barrier 2 is positioned both tangent to the magnetic developer roller 12 and radially adjacent to the doctor blade 14 around the magnetic developer roller 12. As such, the area of the magnetic developer roller 12 between the doctor blade 14 and the barrier 2 is the only area exposed to the full pressure of the medium 3. Thanks to the present invention's utilization of the barrier 2, this exposed area is only in the realm of 25%, compared to other inventions in which up to 50% or even more of the magnetic developer roller 12 may be subject to higher than rated pressures from overloaded medium 3, such as with extended yield cartridges. By reducing the amount of medium 3 in contact with the magnetic developer roller 12, the doctor blade 14 encounters less resistance and pressure from the medium 3 that is scraped off from the magnetic developer roller 12. The reduced pressure experience by the doctor blade 14 correspondingly minimizes operational wear and tear and subsequently increases lifespan.

The sealing blade 15, which is positioned opposite the doctor blade 14 between the photoconductor drum and barrier 2, serves to remove excess medium 3 still attached to the magnetic developer roller 12 as the magnetic developer roller's 12 rotation brings the excess medium 3 past the photo conductor drum and back into the feed section 131. This allows the surface of the magnetic developer roller 12 to be cleaned before it receives a new coating of medium 3. Similar to the doctor blade 14, the sealing blade 15 is positioned within the sealing blade 15 where it tangentially engages the magnetic developer roller 12. The sealing blade 15 is also radially and adjacently positioned around the magnetic developer roller 12, similar to the doctor blade 14. Unlike with the doctor blade 14, however, the sealing blade 15 is positioned to completely remove medium 3 from the magnetic developer roller 12, rather than leaving a thin film as with the doctor blade 14. The positioning of the sealing blade 15 if further defined as being adjacent to the medium 3-free chamber 16 opposite the barrier 2. Describing the barrier 2 in relation to the sealing blade 15, the barrier 2 is positioned tangent to the magnetic developer roller 12 and opposite the sealing blade 15 around the magnetic developer roller 12.

The barrier 2 as described reduces pressure on the magnetic developer roller 12. As a result, this expands the lifespan of the magnetic developer roller 12. By reducing the amount of medium 3 that contacts the magnetic developer roller 12, the benefits are further extended to other components that contact the magnetic developer roller 12, specifically the doctor blade 14 and the sealing blade 15. Thus, the barrier 2 reduces the pressure and resistance encountered by these components, allowing them longer. Furthermore, the reduction of experienced pressure makes the doctor blade 14 and sealing blade 15 more stable; they are less likely to be pushed out of place due to excessive force from the medium 3 via the magnetic developer roller 12. Because their precise positioning is crucial to ideal performance, minimizing operation wear and tear is especially beneficial for the doctor blade 14 and sealing blade 15. The present invention mitigates these downsides and other negatives to using extended yield cartridges and through its inclusion protects core printing components such as the magnetic developer roller 12, doctor blade 14, and sealing blade 15.

The present invention can be assembled using a variety of construction methods. For example, the base 21 and barrier 2 can be constructed or provided separately, and then later connected to each other. Or, preferably, injection molding can be used to create the present invention as a single piece. As with other aspects of the present invention, the construction process used can vary with different embodiments.

Although the invention has been explained in relation to its preferred embodiment, it is to be understood that many other possible modifications and variations can be made without departing from the spirit and scope of the invention as hereinafter claimed.

What is claimed is:

1. A printer cartridge comprising:

a cartridge casing;

a magnetic developer roller located within said cartridge casing;

a hopper for holding a medium;

said hopper having a feed section;

a barrier located within said feed section and positioned tangentially adjacent to said magnetic developer roller so that said magnetic developer roller is exposed to less of said medium, thereby reducing forces applied to said magnetic developer roller by said medium, and so that a medium free chamber located adjacent to said magnetic developer roller and adjacent to said barrier is formed;

said barrier being in contact with said medium on a first side and in contact with said medium free chamber on a second side opposed to said first side;

a doctor blade in contact with said magnetic developer roller for dislodging excess medium as the magnetic developer roller rotates and for creating with said barrier a region on said magnetic developer roller which is exposed to said medium; and a sealing blade located at an opposite end of said medium free chamber from said barrier and forming an end of said medium free chamber.

2. The printer cartridge of claim 1, wherein said feed section is located adjacent to said magnetic developer roller.

3. The printer cartridge of claim 1, wherein said magnetic developer roller is rotatably mounted within the cartridge casing and is positioned lateral and adjacent to the feed section.

4. The printer cartridge of claim 1, wherein said barrier comprises a base and a wall, said base serves as a support that allows the barrier to be mounted to the cartridge casing and said wall is tangentially aligned with the magnetic developer roller.

5. The printer cartridge of claim 4, wherein said wall has a chamfered edge at a top face, and said chamfered edge is oriented towards the feed section and away from the magnetic developer roller so as to slope towards the feed section and thereby ensuring that excess medium remains in the hopper.

6. The printer cartridge of claim 5, wherein said top face reduces an exposure surface area of the magnetic developer roller to the medium by 50%.

7. The printer cartridge of claim 1, wherein the medium free chamber is delineated by the magnetic developer roller, the barrier, and the cartridge casing.

8. The printer cartridge of claim 1, further comprising said sealing blade being positioned opposite the doctor blade.

9. The printer cartridge of claim 1, wherein said doctor blade is positioned within the cartridge casing such that said doctor blade tangentially engages the magnetic developer roller.

10. The printer cartridge of claim 1, wherein said doctor blade is offset from the barrier.

11. The printer cartridge of claim 1, wherein said barrier is tangentially aligned with said magnetic developer roller.

12. The printer cartridge of claim 1, wherein said barrier is connected across the cartridge casing so as to avoid gaps between the barrier and interior faces of the cartridge casing.

* * * * *